United States Patent [19]

Blanc

[11] 4,299,208

[45] Nov. 10, 1981

[54] GUM MASSAGE DEVICE

[75] Inventor: Max A. Blanc, 46 Cite du Lac, St. Jean de Luz, France, 64500

[73] Assignees: Max A. Blanc, St. Jean de Luz, France; William B. Anderson, West Palm Beach, Fla. ; a part interest

[21] Appl. No.: 120,495

[22] Filed: Feb. 11, 1980

[51] Int. Cl.[3] ..... A61H 7/00

[52] U.S. Cl. ..... 128/62 A

[58] Field of Search ..... 128/62 A; 15/110, 167 R, 15/210 R

[56] References Cited

U.S. PATENT DOCUMENTS

| | | | |
|---|---|---|---|
| 2,364,205 | 12/1944 | Fuller | 128/62 A |
| 3,359,588 | 12/1967 | Kobler | 128/62 A |
| 3,491,396 | 1/1970 | Eannarino et al. | 128/62 A X |
| 4,115,893 | 9/1978 | Nakata et al. | 128/62 A |

*Primary Examiner*—John D. Yasko

*Attorney, Agent, or Firm*—Brumbaugh, Graves, Donohue & Raymond

[57] ABSTRACT

A gum massage device adapted to be inserted on a handle and having a longitudinally extending passage containing an intermediate interlocking enlarged formation to provide a resilient cushion for the gum massaging action and interlocking enlarged formations on each side of the intermediate formation.

9 Claims, 6 Drawing Figures

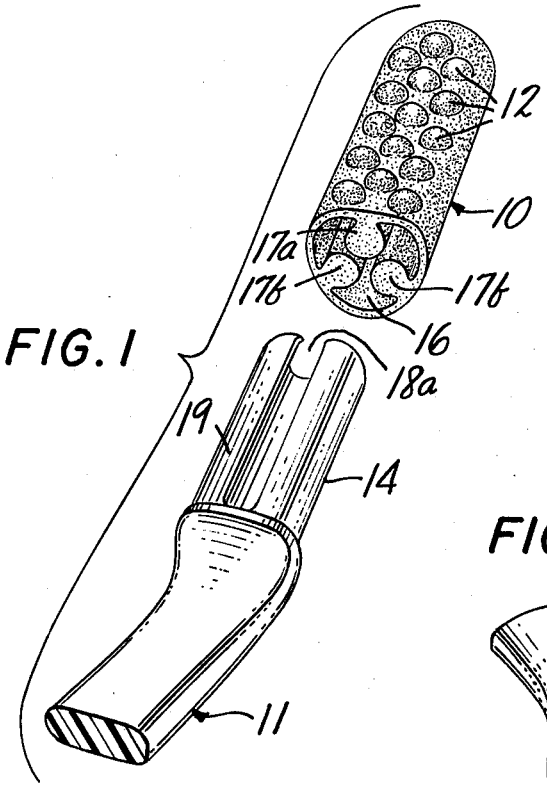
FIG. 1
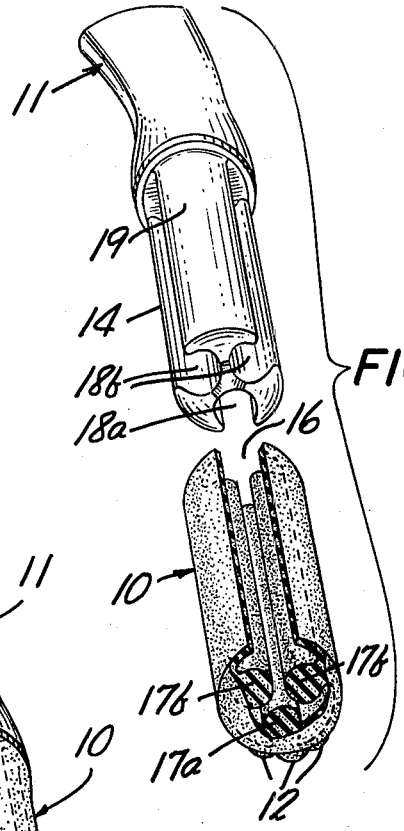
FIG. 2
FIG. 3
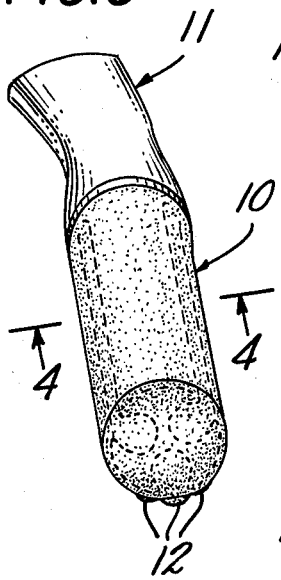
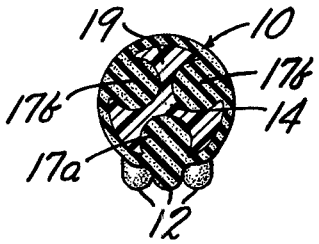
FIG. 4
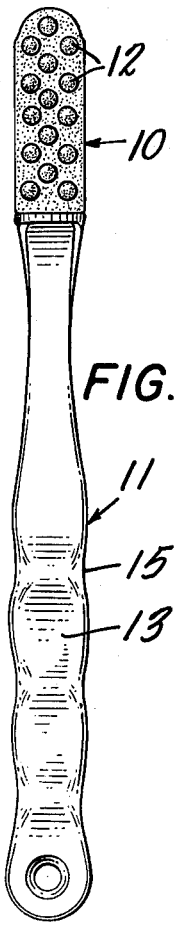
FIG. 5
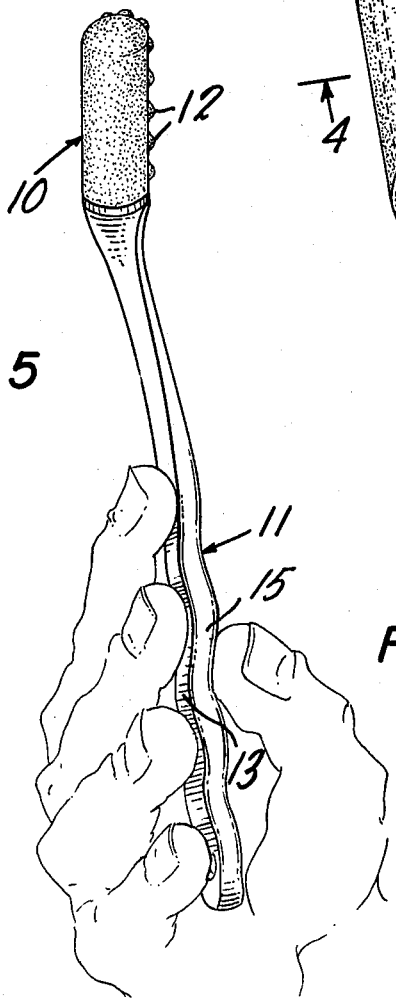
FIG. 6

GUM MASSAGE DEVICE

This invention relates to a novel gum massage device adapted for insertion on a handle and, more particularly, to a novel gum massage device having an improved structure which effectively massages the gums without causing injury or irritation to the gums or the inside tissue of the cheek and which, when inserted on a handle, provides a more effective interlock which minimizes the effects of expansion, contraction and fatigue.

The importance of gum massage is now recognized as essential to proper dental hygiene. The gums provide the natural support for the teeth and massage at regular intervals is necesssary to tone the gums, stimulate blood flow and provide healthy gum tissue. The texture of food normally consumed is too soft to provide adequate exercise for the gums.

A wide variety of gum massaging devices have been heretofore proposed, for example, the gum massaging devices described in the Kobler Pat. No. 3,395,388, issued Dec. 26, 1967, and the Nakata et al. Pat. No. 4,115,893, issued Sept. 26, 1978, but they utilize gum massaging formations which may tend to irritate the gums or inside tissue of the cheek and they lack other design features of the gum massage device of the present invention.

The gum massage device of the present invention embodies an elongated resilient member adapted to be inserted on and interlocked with a handle. The gum massaging surface is provided with a plurality of gum massaging formations of a shape which will provide an effective gum massaging action without injury or irritation to the gums or mouth tissue. Furthermore, the elongated resilient member has a longitudinally extending passage therein configured to interlock with a complementary shaped handle support so that it imparts the resiliency necessary for the massaging action and it provides an effective interlock which minimizes the effects of expansion, contraction and fatigue of the resilient material.

For a complete understanding of the present invention, reference can be made to the detailed description which follows and to the accompanying drawings, in which:

FIG. 1 is an enlarged, exploded view in perspective of the gum massaging device and one end of the supporting handle;

FIG. 2 is a perspective view similar to FIG. 1 as seen from the opposite direction;

FIG. 3 is a view similar to FIG. 2 with the gum massaging device inserted on the handle;

FIG. 4 is a sectional view taken along the line 4—4 of FIG. 3 looking in the direction of the arrows;

FIG. 5 is a plan view of the assembled device; and

FIG. 6 is a side view of the assembled device.

The gum massage device of the present invention includes an elongated member 10 made of resilient material, such as natural rubber, and a rigid handle 11 on which the gum massage device can be mounted. The gum massage device can be permanently mounted on the handle or it can be detachably mounted thereon to permit the gum massage device to be replaced. The handle can be made of a cheap, disposable plastic material or of a more expensive material, such as metal.

A plurality of gum massaging formations 12 are integrally formed along an exterior surface of the resilient body. The gum massaging formations 12, shown somewhat more pronounced in FIG. 4 than in FIG. 1, are preferably upstanding knobs or studs having rounded ends and arranged in a plurality of rows with the formations of adjacent rows being arranged diagonally relative to the longitudinal axis of the gum massaging device. This arrangement permits the gum massaging formations to exert a relatively uniform massaging action on the gums irrespective of the direction of its movement relative to the gums.

The handle 11 includes a hand grip portion 13 remote from the gum massaging device and a support portion 14 on which the gum massage device is mounted. The edges of the handle are provided with a plurality of spaced apart indentations 15 to provide a comfortable and firm grip. Also, the handle itself is sinusoidally curved, as shown in FIG. 6, for convenience in handling.

The gum massage device has a longitudinally extending passage 16 therein open on at least one end. In the preferred embodiment illustrated in the drawings, three elongated, enlarged formations are accommodated within the passage, namely, an intermediate enlarged formation **17*a* which provides a resilient cushion behind the exterior surface on which the gum massaging knobs are formed and a pair of elongated, enlarged formations 17*b* accommodated within said passage on each side of the intermediate formation 17*a* to provide additional interlocking means with the support portion 14 of the handle. The surfaces of the passage defining the formations 17*a* and 17*b*** are preferably of a generally cylindrical shape with the centers of the formations disposed at angles 120° apart from the center of the longitudinally extending passage.

The exterior surface of the support portion 14 of the handle is of generally complementary shape to the interior surface of the passage 16 so that it can be inserted into and interlocked with the passage. Toward this end, the support portion 14 has three cylindrically shaped recesses spaced apart equally around its perimeter, a central recess **18*a* in line with a flat surface of the handle to accommodate the enlarged formation 17*a* and a pair of recesses 18*b* on each side of the central recesses to accommodate the enlarged formations 17*b*. The recesses 18*a*, 18*b* are open at the outer periphery of the support portion of the handle, and the outer surfaces 19** of the support intermediate the recesses are convexly curved.

The gum massage device is forced endwise onto the support portion of the handle and properly oriented thereon so that the formation **17*a* engages the recess 18*a* and the formations 17*b* engage the recesses 18*b*. Interlocking ribs or other means (not shown) may be provided to lock the gum massage device on the handle. The gum massage device can be held and manipulated by the handle to massage the gums. The outer surface of the gum massage device, except for the surface on which the knobs 12** are formed, is preferably generally smooth and the free end thereof rounded so as to avoid injury or irritation to any tissue which they engage.

The gum massage device of the present invention effectively massages the gum surfaces irrespective of the direction of movement of the handle. The enlarged formation **17*a* provides a resilient cushion for the pressure exerted against the gum massaging knobs 12. In the manipulation of the device, circumferential forces will be exerted which tend to impart rotation of the gum massage device relative to the supporting handle, but these forces will be resisted by the substantial area of engagement between the resilient body and the handle. Forces which tend to displace the intermediate formation 17***a* from the recess 18*a* will be resisted by the surface defining the recess 18*a*, the adjacent exterior convex surfaces and the corresponding areas of engagement between the formations 17*b* and the recesses 18*b*. This interlocking action will minimize the effects of expansion and contraction of the resilient body caused by changes in pressure and temperature and will tend to minimize fatigue and prolong the useful life of the device.

The invention has been shown in a single preferred form and by way of example and many modifications and variations can be made therein within the spirit of the invention. The invention, therefore, is not intended to be limited to any specified form or embodiment except in so far as such limitations are expressly set forth in the claims.

I claim:

1. A gum massage device comprising an elongated resilient member, means defining a longitudinally extending passage in said resilient member open on at least one end, a plurality of gum massaging formations on an exterior surface of said resilient formation and a plurality of interlocking formations of generally cylindrical formation and extending longitudinally within and substantially the length of said passage and spaced apart from each other to provide channels for receiving interlocking support formations.

2. A gum massage device comprising an elongated resilient member, means defining a longitudinally extending passage in said resilient member open on at least one end, a plurality of gum massaging formations on an exterior surface of said resilient formation, a plurality of interlocking formations extending longitudinally within said passage and spaced apart from each other to provide channels for receiving interlocking support formations, a handle having an elongated support at one end for receiving the gum massage device thereon, interlocking formations on the support engageable with said channels intermediate the interlocking formations of the gum massage device and longitudinally extending recessed means in said support between the interlocking formations for receiving the interlocking formations of the gum massage device.

3. A gum massage device as set forth in claim 1 in which the gum massage formations include a plurality of rows of rounded knobs in which the knobs of adjacent rows are arranged diagonally relative to the longitudinal axis of the gum massaging device.

4. A gum massage device as set forth in claim 1 in which the interlocking formations are spaced apart equally within said passage.

5. A handle as set forth in claim 2 in which the surfaces defining the longitudinally extending passage and the support portion of the handle are substantially complementary in shape so that substantially the entire outer surface of the support portion is in engagement with substantially the entire inner surface defining the longitudinally extending passage.

6. A handle as set forth in claim 2 in which said recesses are substantially cylindrical in shape with longitudinally extending openings at the outer periphery of the support portion and including convexly curved exterior surfaces on the support portion intermediate the longitudinally extending openings.

7. A gum massage device as set forth in claim 1 in which an intermediate interlocking formation extends longitudinally within the passage behind the exterior gum massaging formations to provide a resilient cushion for the gum massaging action.

8. A gum massage device as set forth in claim 7 including interlocking formations extending longitudinally within the passage on each side of the intermediate interlocking formation.

9. A gum massage device as set forth in claim 2 in which the handle is defined by a pair of surfaces joined together at their edges and in which the surfaces are sinusoidally curved and the edges are provided with a plurality of spaced apart indentations to facilitate gripping the handle.

* * * * *